US005899764A

United States Patent [19]

Harting et al.

[11] Patent Number: 5,899,764

[45] Date of Patent: May 4, 1999

[54] SWITCH CONNECTOR

[75] Inventors: Dietmar Harting, Espelkamp; Günter Pape, Enger; Frank Weichert, Lübbecke, all of Germany

[73] Assignee: Harting KGaA, Germany

[21] Appl. No.: 09/058,925

[22] Filed: Apr. 13, 1998

[30] Foreign Application Priority Data

Apr. 30, 1997 [DE] Germany ..... 197 18 231

[51] Int. Cl.[6] ..... H01R 29/00

[52] U.S. Cl. ..... 439/188; 200/51.1

[58] Field of Search ..... 439/188; 200/51.1

[56] References Cited

U.S. PATENT DOCUMENTS

| | | | |
|---|---|---|---|
| 4,937,404 | 6/1990 | Kitagawa | 200/51.1 |
| 5,352,129 | 10/1994 | Guglhor | 439/188 |
| 5,516,299 | 5/1996 | Fukuda et al. | 439/188 |
| 5,601,442 | 2/1997 | Harting et al. | 439/188 |

FOREIGN PATENT DOCUMENTS

| | | |
|---|---|---|
| 1 31 171 | 1/1973 | Germany . |
| WO93/15535 | 8/1993 | WIPO . |

*Primary Examiner*—Neil Abrams
*Assistant Examiner*—T. C. Patel
*Attorney, Agent, or Firm*—Dorn, McEachran, Jambor & Keating

[57] ABSTRACT

For a switch connector with contact elements disposed in contact cavities of an insulator body, with contact elements with at least one spring-elastic arm in the contact cavities, and in which contact blades of a corresponding mating connector can be inserted in the contact cavities and thus make contact with the contact elements and in which there is provided at least one shorting jumper which short-circuits two contact elements in the absence of an inserted mating connector, the short circuit being broken when the blade contacts are inserted in the contact cavities, it is proposed that the shorting jumper is designed as a rigid contact part and has at least one contact limb which is disposed between the contact spring limbs of the contact elements and that in the contact cavities there is a switching element provided with a switching spring limb, the switching spring limb acting on the contact spring limb of the contact element in such a way that the latter is displaced until the switching spring limb bears against the contact limb of the shorting jumper.

10 Claims, 4 Drawing Sheets

SWITCH CONNECTOR

Figure 1:
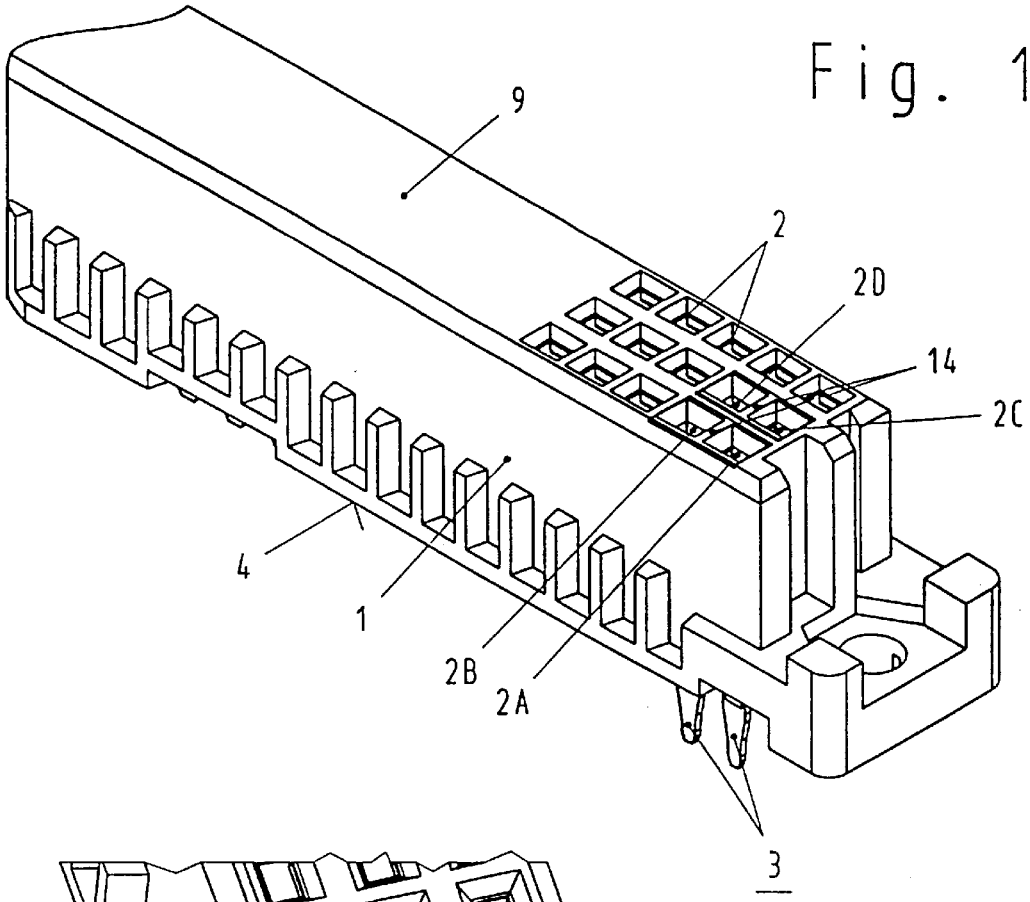

The invention concerns a switch connector with contact elements disposed in contact cavities of an insulator body, with contact elements with at least one spring-elastic arm in the contact cavities, and in which contact blades of a corresponding mating connector can be inserted in the contact cavities and thus make contact with the contact elements and in which there is provided at least one shorting jumper which short-circuits two contact elements in the absence of an inserted mating connector, the short circuit being broken when the blade contacts are inserted in the contact cavities.

Such switch connectors are used in electronic systems in which selected contacts or contact elements of the one plug-and-socket connector, namely the switch connector, must not terminate as "open" contacts (signal lines), but must be connected to one another when the plug-and-socket connection is broken.

Known from U.S. Pat. No. 5,352,129 A is a switch connector in which each of the contact cavities of the socket terminal strip is fitted with a two-limb spring contact which serves as a locator and means of contact for the blade contacts of the mating connector. The spring limbs of two adjacent spring contacts which are to be interconnected have contact lugs, on one of each of the two spring limbs, which project into the open space between these contact cavities in such a way that the contact lugs overlap and form an electrical connection with one another when the blade-connector strip is not inserted. When the blade-connector strip is inserted, the spring limbs of the socket contacts are displaced in such a way that the contact lugs between the contact cavities move apart from one another and the electrical connection between these two contacts is broken.

Also known is the practice of inserting into the open space between the adjacent spring contacts which are to be interconnected a rigid contact bridge which performs the function of the overlapping contact lugs. In this case, in the absence of an inserted blade-connector strip, the four spring limbs of the adjacent spring contacts are in contact with this contact bridge and create an electrical connection between these two spring contacts. When the blade-connector strip is inserted, all four spring limbs of the two spring contacts are moved away from the said contact bridge and the electrical connection is broken.

In addition from DE 21 31 171 B1 a plug-connector with a shorting jumper is known, whereby two side by side lying socket contacts are leadingly connected by a shorting jumper when the mating connector is not inserted. When the mating connector is inserted, the short circuit is opened by an isolated action member, which acts on the shorting jumper.

In order to assure a required reliability of switching function in technical application, it is necessary to prevent both signal information errors due to bounce pulses during the making and breaking operations and excessive contact resistances in the connected state, which can only be achieved through a sufficiently great contact force by means of the spring elements. Reliable breaking of the electrical connection in the non-connected state must be assured through a sufficiently large contact clearance (air gap and creepage distance).

In the case of the solutions mentioned above, there is a correlation between the contact force in the short-circuited state and the contact clearances in the non-short-circuited state. In the non-short-circuited state, i.e., when the blade-connector strip is inserted, the spring limbs are each displaced by <½ a blade width, so that it is only possible to produce a maximum contact clearance, corresponding to the blade thickness less the thickness of the contact bridge. The contact clearances can only be increased through reduction of the thickness of the contact bridge, but this then coincidentally results in lesser contact forces in the short-circuited state.

The functional reliability required in technical applications of such switch connectors is therefore not optimally achieved by the known solutions. The object of the invention is to design a switch connector of the type initially referred to in such a way that the bounce behavior during the insertion operation, the contact resistance in the connected state and the contact clearance in the non-connected state are brought up to a substantially improved level for technical applications.

This object is achieved, according to the invention, in that the shorting jumper is designed as a rigid contact part and has at least one contact limb which is disposed between the spring-elastic arms of the contact elements, and that in the contact cavities of each of the contact elements to be switched there is a switching element provided with a switching spring limb, the switching spring limb acting on the spring-elastic arm of the contact element in such a way that the latter is displaced until the switching spring limb bears against the contact limb of the shorting jumper.

Advantageous embodiments of the invention are disclosed in claims 2 to 10.

The particular advantages achieved by the invention are that there is a reduced bounce behavior during the insertion and removal operations and information error pulses are thus avoided, there being lower contact resistances in the connected state due to high contact forces and larger contact clearances (air gap and creepage distances) in the non-connected state. By this means, a reliable and definite switching behavior is achieved.

Additionally achieved are optimized functional conditions, due to allocation of the contact function to the blade-connector strip and allocation of the switching function to three functional elements, as well as a reliable short-circuiting function by means of three contact points per contact cavity, no additional, insulating functional parts being required for the breaking of the short-circuit connection.

Moreover, it is possible to use already existing two-limb spring contacts by removing only one of the two spring limbs, and existing standard commercial mating connectors can also be used.

Figure 2:
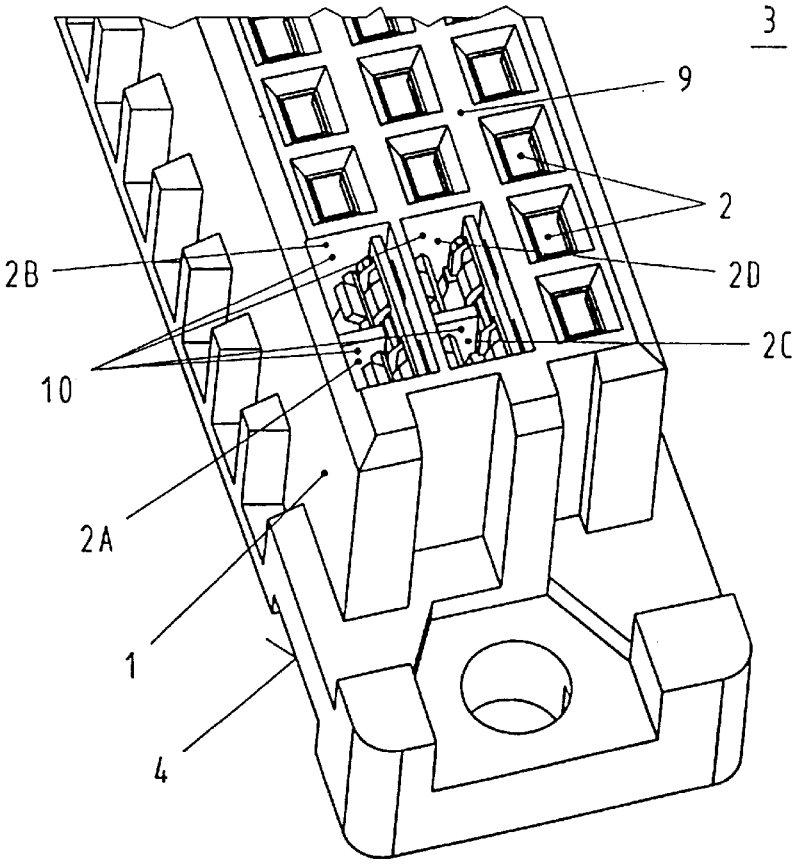
Figure 3:
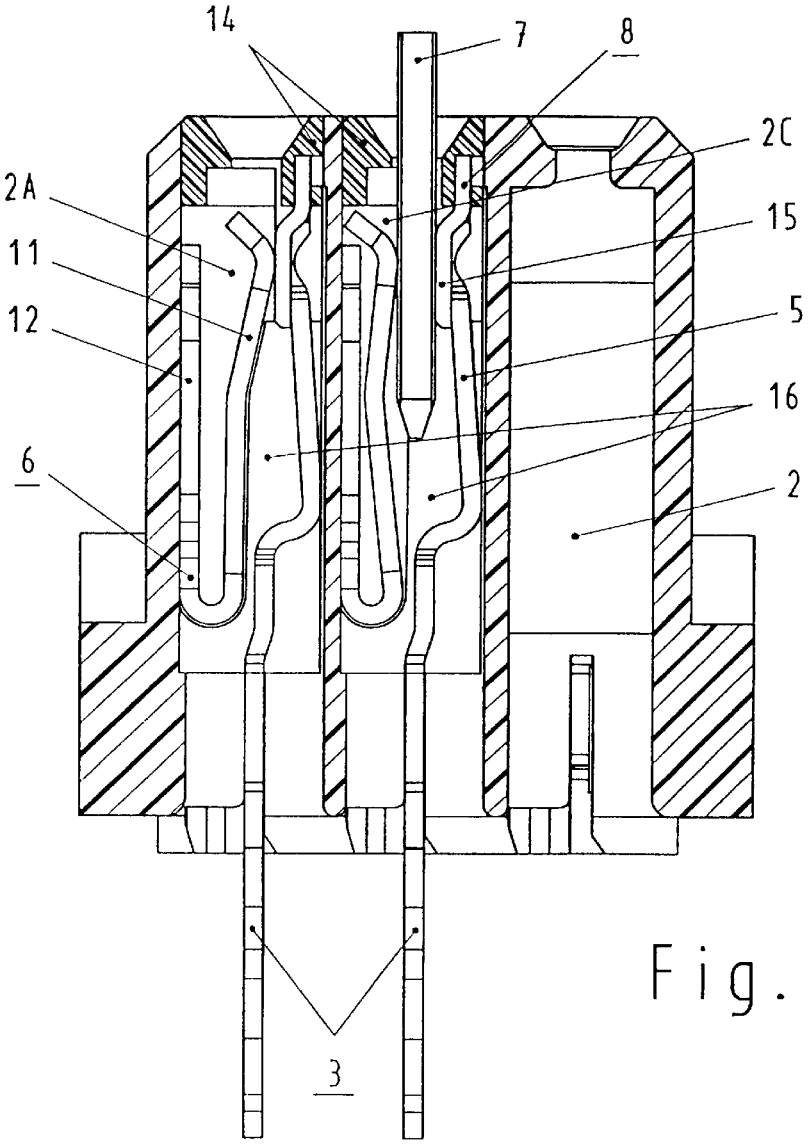
Figure 4:
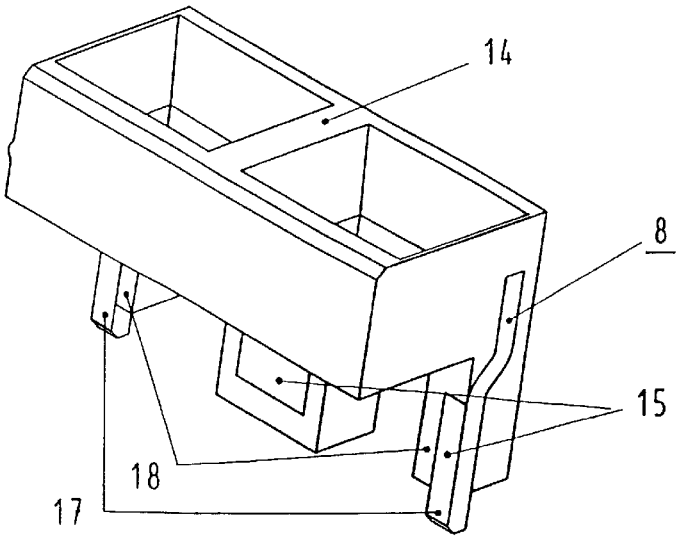
Figure 5A:
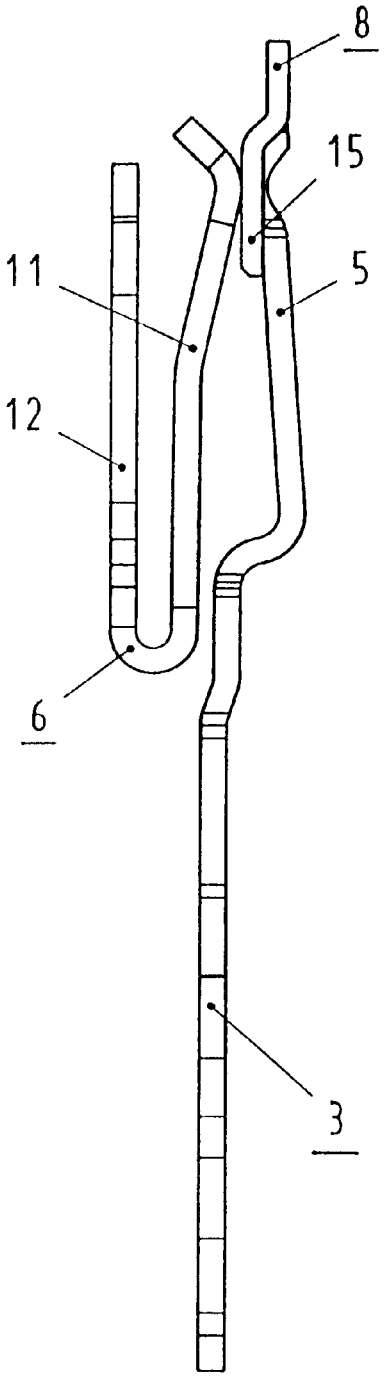
Figure 5B:
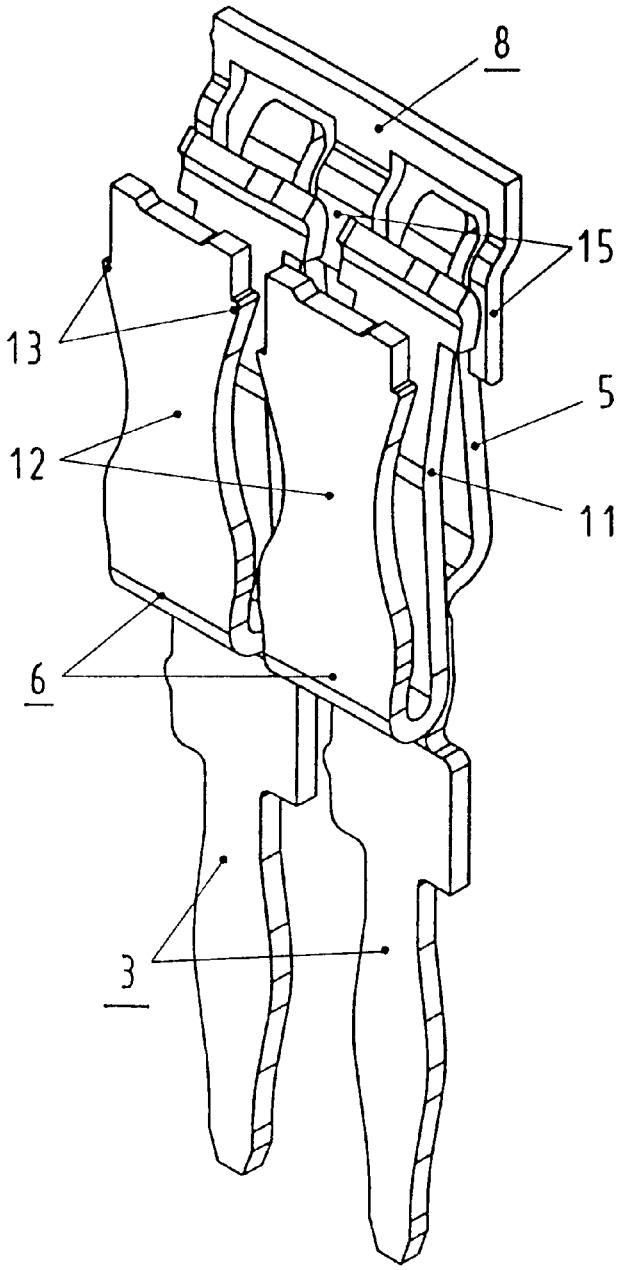
Figure 6A:
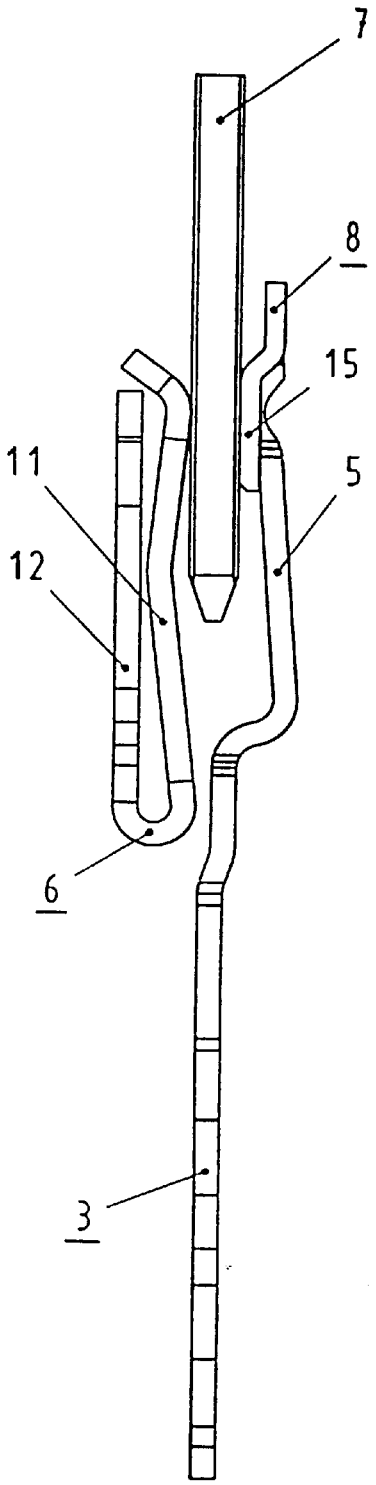
Figure 6B:
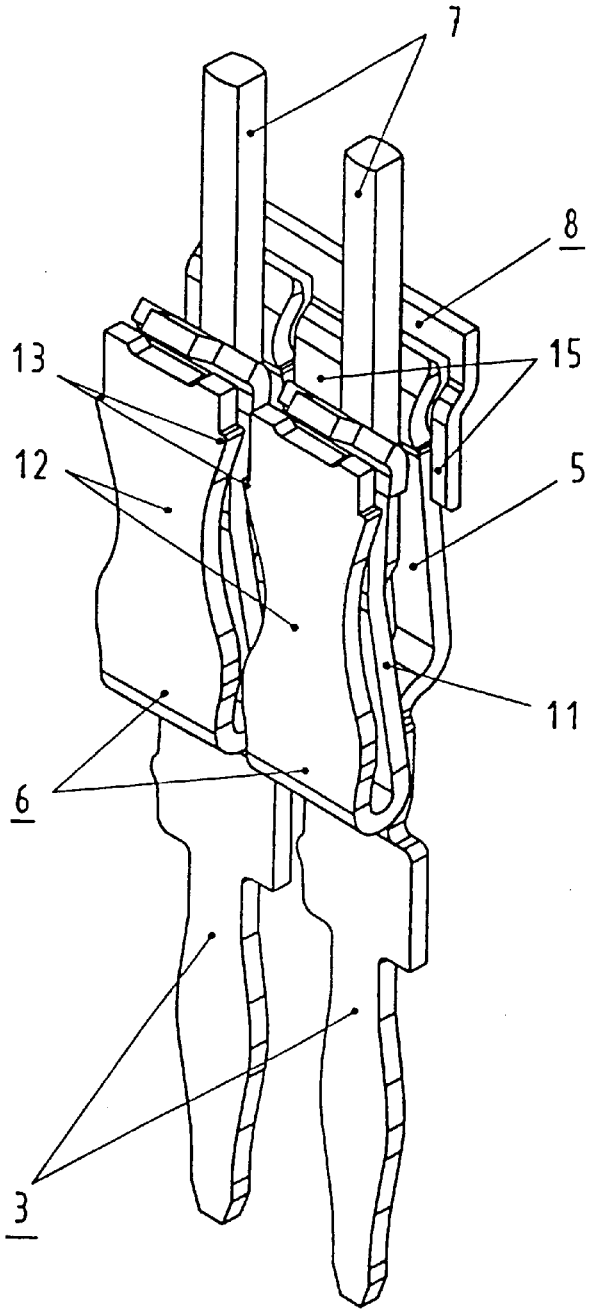

An embodiment example of the invention is described more fully below and depicted in the drawing, wherein:

FIG. 1 shows a partial view of a switch connector,

FIG. 2 shows an enlarged partial view of the switch of FIG. 1 with uncovered switching contact cavities, FIG. 3 shows a sectional view of the switch connector of FIG. 1 with contact elements in the two different switching states, FIG. 4 shows a cover with injection-molding around the shorting jumper, FIGS. 5A, 5B show a representation of the contact elements in the short-circuited state, and FIGS. 6A, 6B show a representation of the contact elements the non-short-circuited state, with the blade contacts inserted.

The switch connector depicted in FIG. 1 consists essentially of an insulator body 1 provided with contact cavities 2A, 2B, 2C, 2D into which contact elements 3 are fitted from the underside 4 and are secured, the contact elements 3 being in the form of contact spring limbs 5. The contact cavities 2 are arranged in rows and columns and the shape and insertion geometry of the switch connector is such that a corresponding mating connector with blade contacts can be plugged into it. The overall geometry of the connector is designed in accordance with standard commercial DIN plug-and-socket connectors. Two adjacent contact cavities which are to be interconnected are each provided with an additional switching element 6 which, in the absence of inserted blade contacts 7, short-circuit the contact spring limbs 5 in these contact cavities by means of a shorting jumper 8 and which, in the presence of inserted blade contacts 7, are moved away from the shorting jumper 8 so that the short circuit is broken.

FIG. 2 shows an enlarged partial view of the switch connector from FIG. 1 with uncovered contact cavities 2A, 2B 2C, 2D on the upper side 9 of the insulator body 1. The additional switching elements 6 are fitted into the contact cavities 2A, 2B 2C, 2D via the opening 10, the shorting bridge 8 being likewise positioned via the said opening, passing through the two contact cavities 2A, 2B and 2C, 2D.

FIG. 3 shows a sectional view of the switch connector, through the contact cavities 2A, 2C fitted with the switching elements. The connected short-circuit state is shown in the contact cavity 2A and the non-connected state, with inserted blade contacts 7, is shown in the contact cavity 2C. The switching elements 6 fitted into the openings 10 from the top side 9 of the insulator body consist of a switching spring limb 11 and a fixing limb 12 which is equipped with laterally shaped, harpoon-type locking hooks 13 or lateral fixing spring elements. The switching element as a whole is bent in a U shape, the two limbs 11 and 12 being adjacent to one another. This enables the switching element 6 to be pressed into the contact cavities 2A, 2B, 2C, 2D and positioned through the openings 10. The shorting jumper 8 passes through both contact cavities level with the contact points of the spring and switching contacts and, as shown in FIG. 4, is inserted into the cover 14, which serves to close the opening 10.

The cover can be produced as an injection-molded plastic part, the cover material being molded around the shorting jumper. The shorting jumper can also be inserted in the insulating body. The shorting bridge 8 is positioned so that its contact limbs 15 are level with the contact spring limbs 5 which are displaced and subjected to load. It is fixed in position by means of both the cover 14 and blind holes in the cavity walls 16 into which project the elongated contact limbs 17 of the shorting jumper 8.

The switching function is explained in FIGS. 5A, 5B and FIGS. 6A, 6B. The shorting bridge 8 is shaped so that it passes around the contact spring limbs 5 and cannot directly make contact with them. Between the contact limbs 15 and the contact spring limbs 5 is an insulating wall 18 of the cover 14 by means of which the contact clearance and, consequently, the creepage distances, remain assured. As mentioned, the contact limbs 15 of the shorting jumper 8 are level with the displaced contact spring limbs 5. In the short-circuited state (FIGS. 5A, 5B), the contact spring limbs 5 are displaced by the switching elements 6 to the extent that the switching spring limbs 11 bear against the contact limbs 15 of the shorting jumper 8. In this position, the contact elements 3 are short-circuited by means of the switching elements 6, through the shorting jumper 8. In the non-connected state (FIGS. 6A, 6B), when the blade contacts are inserted, the contact spring limbs 5 remain displaced by the blade contacts 7 and the switching spring limbs 11 of the switching elements 6 are each moved away from the shorting jumper 8 by one blade thickness. The sum of the contact clearances is thus 2x the blade thickness and there is no longer an electrical connection between the contact spring limbs 5 and the shorting jumper 8. The short circuit is thus broken. The application of the switching elements 6 nullifies the correlation of the contact force and the contact clearance.

Although it is assumed above that two directly adjacent contact elements are connected (short-circuited), it is possible to make provision, if necessary, whereby the contact elements to be connected are not directly adjacent. In this case, the shorting jumper can be designed so that the contact cavities of the contact elements which are not to be connected are by-passed.

We claim:

1. A switch connector comprising contact elements (3) disposed in contact cavities (2A, 2B, 2C, 2D) of an insulator body (1), said contact elements, each having at least one spring elastic arm (5), which contact blades of a mating connector when inserted in the contact cavity;

at least one shorting jumper (8) contacts a switch element (6) and short-circuits two adjacent contact elements in absence of said mating connector blades, the short circuit being broken when the blade contacts (7) are inserted in the contact cavities, wherein the shorting jumper (8) having a rigid contact part and at least one contact limb (15) which is disposed between the spring elastic arms (5) of the contact element (3);

said switching element is provided with a switching spring limb (11), the switching spring limb (11) acting on the spring elastic arm (5) of the contact element (3), in such a way that upon insertion of the mating connector blade, the switching spring limb (11) is displaced until the switching limb (11) does not bear against the contact limb (15) of the shorting jumper (8) thereby removing the short circuit between the two contact elements (5).

2. The switch connector according to claim 1, wherein in that the spring-elastic arm of the contact element (3) is designed as a contact spring limb (5).

3. The switch connector according to claim 1, wherein the contact cavities (2A, 2B, 2C, 2D) have an upwardly facing opening (10) which can be closed at least in part by a cover (14).

4. The switch connector according to claim 3, wherein the openings (10) of the contact cavities (2A, 2B, 2C, 2D) are closeable at least in part by a common cover (14).

5. The switch connector according to claim 3, wherein in that the shorting jumper (8) extends into the cover (14).

6. The switch connector according to claim 3, wherein in that the shorting jumper (8) is inserted in the contact cavities (2A, 2B, 2C, 2D) of the contact elements to be switched together.

7. The switch connector according to claim 1, wherein in that the switching springs consist of a fixing limb (12) and an elastic switching spring limb (11) and have an overall approximate U shape.

8. The switch connector according to claim 6, wherein in that harpoon-type locking hooks (13) are provided on the fixing limb (12).

9. The switch connector according to claim 1, wherein in that the shorting jumpers (8) are designed so that one or more contact cavities are bypassed.

10. The switch connector according to claim 1, wherein in that contact elements (3) which are to be interconnected can be discretionally selected from the available contact cavity positions.

* * * * *